US007168492B2

(12) United States Patent
Laplante et al.

(10) Patent No.: US 7,168,492 B2
(45) Date of Patent: Jan. 30, 2007

(54) WELLBORE ANNULUS FLUSHING VALVE

(75) Inventors: Tony Laplante, Aberdeen (GB); Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 17 days.

(21) Appl. No.: 10/550,917

(22) PCT Filed: Mar. 29, 2004

(86) PCT No.: PCT/GB2004/001344

§ 371 (c)(1),
(2), (4) Date: Nov. 22, 2005

(87) PCT Pub. No.: WO2004/085793

PCT Pub. Date: Oct. 7, 2004

(65) Prior Publication Data

US 2006/0118306 A1 Jun. 8, 2006

(30) Foreign Application Priority Data

Mar. 28, 2003 (GB) ..... 0307237

(51) Int. Cl.
*E21B 34/06* (2006.01)

(52) U.S. Cl. ..... 166/319; 166/323; 166/325; 166/331; 166/332.8

(58) Field of Classification Search ..... 166/323, 166/325, 319, 331, 332.8
See application file for complete search history.

(56) References Cited

U.S. PATENT DOCUMENTS 3,826,309 A 7/1974 Tausch
4,185,690 A 1/1980 Kinney
4,291,722 A 9/1981 Churchmon
4,378,842 A 4/1983 Patel
4,393,930 A 7/1983 Ross et al.
4,474,241 A * 10/1984 Freeman ..... 166/317
4,574,889 A 3/1986 Pringle
4,577,694 A 3/1986 Brakhage
4,615,394 A * 10/1986 Kuhlman, Jr. ..... 166/327
4,791,991 A 12/1988 Morris et al.
4,834,183 A 5/1989 Vizant et al.
5,327,960 A * 7/1994 Cornette et al. ..... 166/51
5,415,237 A 5/1995 Strattan
5,636,661 A 6/1997 Moyes
6,209,663 B1 4/2001 Hosie

* cited by examiner

*Primary Examiner*—David Bagnell
*Assistant Examiner*—Robert Fuller
(74) *Attorney, Agent, or Firm*—Dykema Gossett PLLC

(57) ABSTRACT

The invention relates to downhole wellbore apparatus and particularly, but not exclusively, to apparatus for use in wellbore cleaning operations. A downhole tool (2) comprises a body (4) having a bore extending longitudinally therethrough, wherein the tool (2) further comprises a one-way valve (24,26) for allowing a flow of fluid in a first direction through the tool bore and preventing a flow of fluid in a second direction through the tool bore, the second direction being opposite to the first direction. The tool further comprises mandrel (38) for rendering the one-way valve (24,26) inoperable so as to be ineffective at preventing fluid flow; and a shear pin assembly (44,40) for selectively making the one-way valve operable so as to be effective at allowing fluid flow in the first direction and preventing fluid flow in the second direction.

14 Claims, 7 Drawing Sheets

WELLBORE ANNULUS FLUSHING VALVE

The invention relates to downhole wellbore apparatus and particularly, but not exclusively, to apparatus for use in wellbore cleaning operations.

It is common practice in the oil and gas drilling industries to periodically clean a wellbore so as to ensure wellbore integrity and maximise the efficiency of oil and gas recovery operations. A technique used in this regard involves pumping a suitable fluid downhole through the annulus formed between the wellbore and downhole equipment located therein. The objective of this operation is to flush unwanted debris down the annulus and back uphole via the interior of the downhole equipment. If considered desirable, the equipment may include a junk catcher in which any unwanted debris flowing uphole within the equipment may be retained. The remaining fluid flow continues to the surface.

A problem can be encountered with the aforementioned cleaning technique in circumstances where it is undesirable for certain materials within the wellbore to be brought to the surface. For example, a wellbore cleaning operation will frequently be conducted in a wellbore which is not considered live (in other words, a wellbore which is not in fluid communication with an oil resource). However, when the precise location of an oil resource is not known for example, it is possible for a wellbore cleaning operation to flush an unexpected mixture of drilling fluid, debris and oil uphole to the surface. This recovery of oil is undesirable and can lead to pollution of the environment.

It is an object of the present invention to improve the downhole tool typically used in wellbore cleaning operations.

The present invention provides a downhole tool comprising a body having a bore extending longitudinally therethrough, wherein the tool further comprises a one-way valve for allowing a flow of fluid in a first direction through the tool bore and preventing a flow of fluid in a second direction through the tool bore, the second direction being opposite to the first direction; means for rendering the one-way valve inoperable so as to be ineffective at preventing fluid flow; and means for selectively making the one-way valve operable so as to be effective at allowing fluid flow in said first direction and preventing fluid flow in said second direction.

Thus, a string of cleaning equipment including the downhole tool of the present invention can be used in a conventional way whilst the one-way valve is rendered inoperable. However, if undesirable materials (e.g. oil deposits) are recovered at the surface, then the means for selectively making the one-way valve operable may be activated. In this way, the one-way valve will be subsequently capable of allowing a flow of fluid in a first direction through the tool bore whilst preventing a flow of fluid in the second direction through the tool bore. The arrangement of the tool in the string may be such that said first direction is that taken by fluid flowing in a generally downhole direction. Thus, fluid flowing in the opposite direction towards the surface will be resisted. Pollution to the environment may be thereby limited. Furthermore, when the string of equipment is removed from the wellbore, the one-way valve allows fluid to flow downwardly relative to the equipment and drain therefrom.

Preferably, the means for rendering the one-way valve inoperable comprises means for restricting movement of said valve. Said movement restricting means may be movable relative to the tool body and may be biased towards a position wherein movement of the one-way valve is not restricted so as to render said valve inoperable. It is also preferable for said means for selectively making the one-way valve operable to comprise means for releasably retaining said movement restricting means in a position wherein the one-way valve is inoperable. It is particularly desirable for said means for releasably retaining said movement restricting means to comprise a shear pin securing said movement restricting means to the tool body.

The means for selectively making the one-way valve operable may comprise a nozzle which is mounted on said movement restricting means and is movable between a first position, in which a flow of fluid through the body bore is resisted by the nozzle, and a second position, in which a flow of fluid through the body bore is not resisted by the nozzle or is resisted to a lesser extent by the nozzle than when the nozzle is in the first position. The nozzle may also be mounted on said movement restricting means with a pivotal connection so that the nozzle tends to be moved to the first position by a fluid flowing through the tool bore in said first direction. Preferably, means are provided for retaining the nozzle in the second position when said movement restricting means is in a position wherein movement of the one-way valve is not restricted so as to render said valve inoperable.

Also, the one-way valve may comprise a closure member pivotally mounted to the tool body and movable between a first position, in which fluid within the body bore may flow passed the closure member, and a second position, in which fluid within the body bore is prevented from flowing passed the closure member so that fluid on one side of the closure member is isolated from fluid on an opposite side of the closure member. The closure member may be biased towards the second position.

Ideally, the means for releasably retaining said movement restricting means comprises a latching means. The latching means may comprise a pin mounted to one of the tool body and movement restricting means; and a groove, for receiving the pin, mounted in the other of the tool body and movement restricting means. The groove preferably defines a closed loop.

An embodiment of the present invention will now be described with reference to the accompanying drawings, in which.

Figure 1:
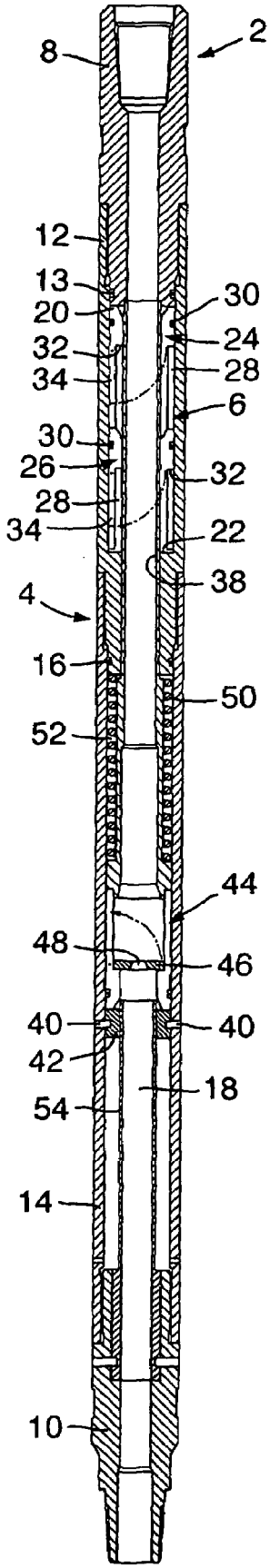
FIG. 1 is a cross-sectional side view of an embodiment of the present invention arranged with the one-way valve rendered inoperable.

The accompanying drawings show a downhole valve 2 which comprises a body 4, a one-way valve assembly 6 mounted within the body 4, and a plurality of further components mounted within the body 4 for rendering the one-way valve assembly 6 inoperable and, as required, selectively making the one-way valve operable. All these components are discussed in greater detail below.

The body 4 comprises standard uphole and downhole crossover members 8,10 for allowing the downhole valve 2 to be connected to additional equipment within a cleaning string. The uphole crossover member 8 is threadedly connected to an uphole body component 12 and sealed therewith by means of an O-ring seal 13. The downhole crossover member 10 is threadedly connected to a downhole body component 14. Both the uphole and downhole body components 12,14 are threadedly connected to one another. A leaking of fluid between the connection of the two body components 12,14 is prevented by means of an O-ring seal 16 between the two body components. The crossover members 8,10 and the uphole and downhole body components 12,14 have a generally cylindrical shape and, when assembled with one another, define a generally cylindrical body 4 having a bore 18 extending longitudinally therethrough. In use, wellbore fluid flushed through the annulus will flow upwardly through the string to which the valve 2 is connected and, in turn, through the bore 18 of the valve body 4.

The downhole end of the uphole crossover member 8 defines a downwardly facing annulur shoulder 20 which inwardly projects into the body bore 18. An upwardly facing annular shoulder 22 having the same dimensions as the downwardly facing shoulder 20 is defined on the uphole body component 12 in a position downhole of the downwardly facing shoulder 20. A circumferential recess in the body bore 18 is thereby provided in which the one-way valve assembly 6 is located.

The one-way valve assembly 6 comprises two flapper cartridges 24,26 located one above the other. Each flapper cartridge 24,26 comprises a cylindrical body 28 having an outer cylindrical surface in contact with the inner surface of the uphole body component 12 and sealed there against with an O-ring seal 30. Each cartridge body 28 defines an annular valve seat 32 upon which a flap 34 pivotally connected to the cartridge body 28 by means of a hinge 36 may locate. Each flap 34 is biased by means of a spring (not shown) towards a position wherein the flap 34 is engaged with the associated seat 32 so as to seal the body bore 18. The annular surface of each valve seat 32 is downwardly facing and each flap 34 is arranged so as to be movable from the associated valve seat 32 against the spring bias by a fluid flowing downhole through the body bore 18.

Figure 2:
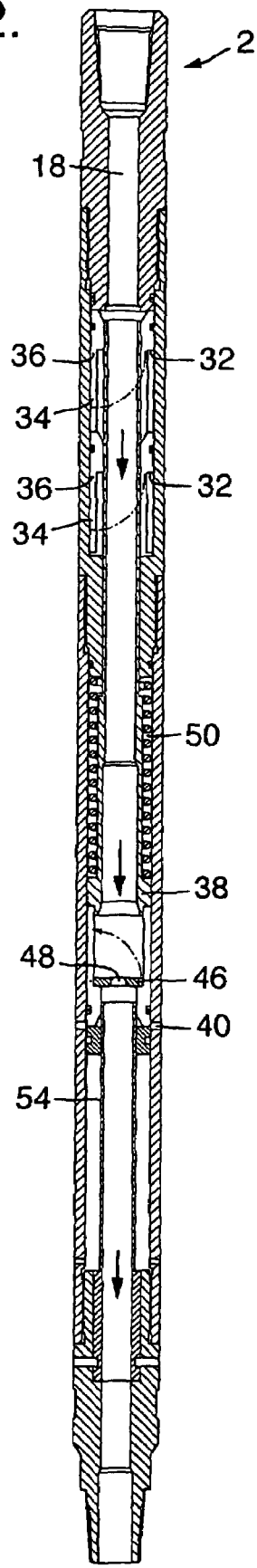
FIGS. 2 and 3 are cross-sectional side views of the embodiment of FIG. 1 wherein means for selectively making the one-way valve operable is being progressively moved so as to make said valve operable.
Figure 3:
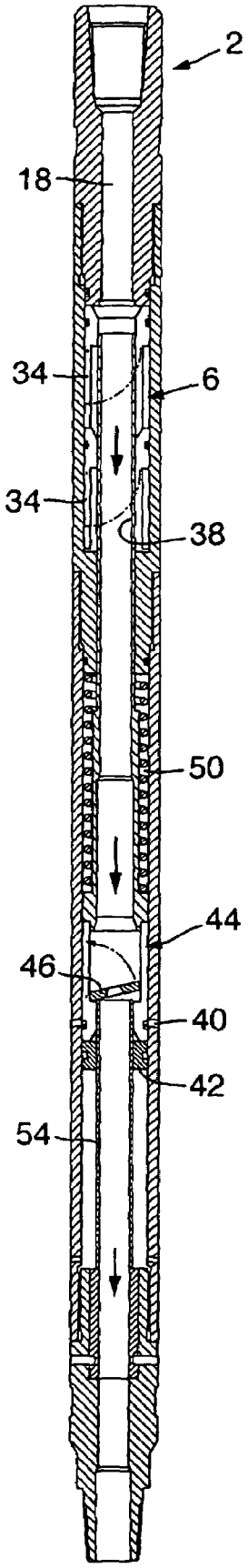

When the downhole valve 2 is run in hole, the one-way valve assembly 6 is in an inoperable state. In other words, the flaps 34 are restrained so that they cannot seal against the valve seat 32 and thereby prevent an uphole flow of fluid through the body bore 18. As shown in each of the configurations of FIGS. 1 to 3, the flaps 34 are retained in a position spaced from the valve seats 32 by means of an elongate cylindrical mandrel 38. When the downhole valve 12 is configured for running in hole (as shown in FIG. 1), the mandrel 38 abuts at its uphole end with the downhole end of the uphole crossover member 8 and is retained in this position relative to the body 4 by means of four shear pins 40 mounted to the downhole body component 14. The shear pins 40 retain an annular block 42 in a fixed axial position on the interior surface of the downhole body component 14. The annular block 42 provides an upwardly facing annular surface upon which the mandrel 38 is supported.

Located between the downhole end of the mandrel 38 and the upwardly facing annular surface of the block 42 is a third flapper cartridge 44. This further flapper cartridge 44 is identical to the flapper cartridges of the one-way valve assembly 6 other than in that the cartridge 44 is located in an inverted orientation (i.e. with the annular valve seat facing uphole) and in that the flap 46 of the further cartridge 44 is provided with a central aperture 48 extending therethrough. By virtue of the aperture 48, it will be understood that the flap 46 operates as a nozzle within the body bore 18. In FIG. 1 of the accompanying drawings, the flap 46 is shown biased into engagement with the valve seat. As such, the flap 46 extends across the body bore 18 and provides resistance to fluid flowing downhole through the apparatus 2. However, fluid flowing uphole through the apparatus 2 will displace the flap 46 and pass through the body bore 18 relatively unimpeded.

A spring 50 is located in a spring chamber 52 defined between a downhole portion of the mandrel 38, the downhole end of the uphole body component 12 and an uphole portion of the downhole body component 14. The spring 50 is compressed within the chamber 52 so as to press upwardly on the downhole end of the uphole body component 12 and downwardly on the mandrel 38. The mandrel 38 is thereby biased downhole relative to the body 4. As a consequence, the mandrel 38 presses against the further flapper cartridge 44 which in turns presses against the annular block 42. The spring bias is not however of sufficient magnitude to shear the shear pins 40. As will be explained hereinafter, the shear pins 40 are sheared by selectively increasing the rate of fluid flow downhole through the bore 18 and the aperture 48.

A cylindrical tungsten carbide stinger 54 is secured to, and extends upwardly from, the downhole crossover member 10. The outer diameter of the stinger 54 is less than the inner diameter of the annular block 42, the body of the further flapper cartridge 44 and a lower portion of the mandrel 38 so as to allow these components to move downwardly between the stinger 54 and the downhole body component 14 once the shear pins 40 have been sheared (see FIGS. 2 to 4). When the apparatus 2 is configured for running in hole (see FIG. 1), the uphole end of the stinger 54 is located uphole of the annular block 42 but downhole of the valve seat of the further flapper cartridge 44 so as to avoid hindering a sealing engagement of the flap 46 with said valve seat. The inner diameters of the stinger 54, the upper portion of the mandrel 38 and the uphole and downhole crossover members 8,10 are approximately the same so as to minimize losses through the apparatus 2.

In use, the downhole valve 2 will be typically run downhole as part of a cleaning string. The valve 2 will be run in the configuration shown in FIG. 1. In other words, the valve 2 is run with the mandrel 38 located in the uphole position so that the one-way valve assembly 6 is rendered inoperable (i.e. incapable of restricting fluid flow through the apparatus bore 18). The lower flapper cartridge 44 is nevertheless operable and will tend to oppose fluid flowing downhole through the valve 2. As the cleaning string is run in hole, wellbore fluid may drain into the valve 2 from the downhole end thereof and, in so doing, may rotate the flap 46 upwardly against the spring bias associated with said flap. Once the cleaning string is in a required position, the wellbore annulus may be flushed by pumping fluid down the annulus and upwardly via the bore extending longitudinally through the cleaning string. This longitudinal bore includes the bore 18 of the valve 2 and it will be appreciated that the ability of the flap 46 to hinge upwardly ensures this upward flow is not unduly resisted.

Figure 4:
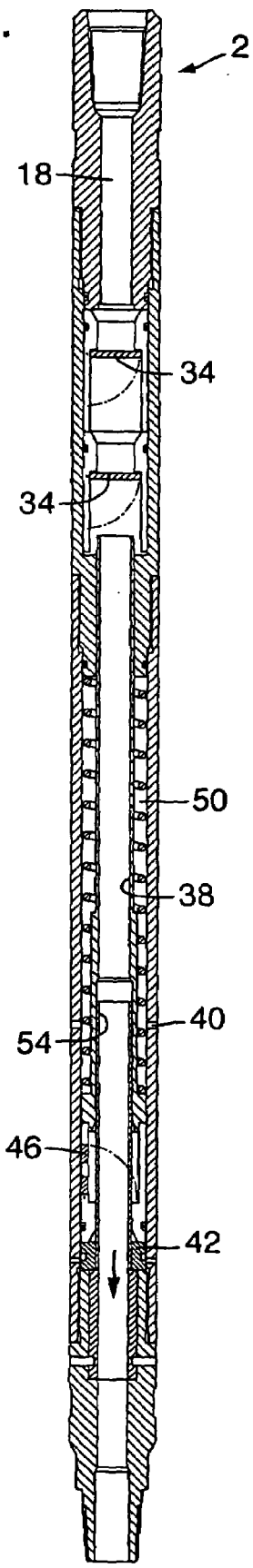
FIG. 4 is a cross-sectional side view of the embodiment of FIG. 1 wherein the one-way valve is operable.

If polluting materials such as oil deposits are recovered at the surface, then any further migration of these materials to the surface may be prevented through activation of the one-way valve assembly 6. This activation is achieved by reversing the fluid flow and pumping fluid downwardly through the bore 18. In turn, the flap 46 moves into engagement with its associated valve seat (under the combined influence of the downward fluid flow and associated spring bias). This configuration is shown in FIG. 1. The aperture 48 in the flap 46 allows fluid to continue to flow down through the cleaning string, but the flap 46 itself allows the fluid to generate a sufficient downward force on the annular block 42 to shear the shear pins 40 (see FIG. 2). Once the shear pins 40 have been sheared, the mandrel 38, flapper cartridge 44 and annular block 42 are pressed downhole by the compression spring 50. As will be seen with reference to FIG. 3, as the lower flapper cartridge 44 is pressed over the stinger 54, the upper end of the stinger 54 abuts the flap 46 and rotates said flap 46 against the associated spring bias. With reference to FIG. 4, it will be seen that as the mandrel 38 is pressed further downhole relative to the body 4, the flap 46 is rotated through approximately 90° and locates in the annular space between the stinger 54 and the downhole body component 14. Also, as will be seen from FIG. 4, the downhole movement of the mandrel 38 results in the upper end thereof becoming spaced from the flaps 34 of the one-way valve assembly 6 to the extent that said flaps 34 are free to rotate under their associated spring bias through 90° and thereby engage with their associated valve seats 32. In this way, a subsequent migration of fluid (located downhole of the one-way valve assembly 6) upwardly passed said assembly 6 to the surface is prevented. However, fluid may nevertheless be pumped downhole via the bore 18. Such a downhole fluid flow is not obstructed by the lower flapper cartridge 44 since the flap 46 thereof is rendered inoperable by the stinger 54. Wellbore fluid is therefore free to flow downwardly through the apparatus 2 and drain therefrom when the cleaning string is run out of hole.

The present invention is not limited to the specific embodiment described above. Modifications and alternative materials will be apparent to a reader skilled in the art. For example, the flap 46 may be provided without the aperture 48 so that the one-way valve assembly may be activated with static fluid pressure.

Figure 5:
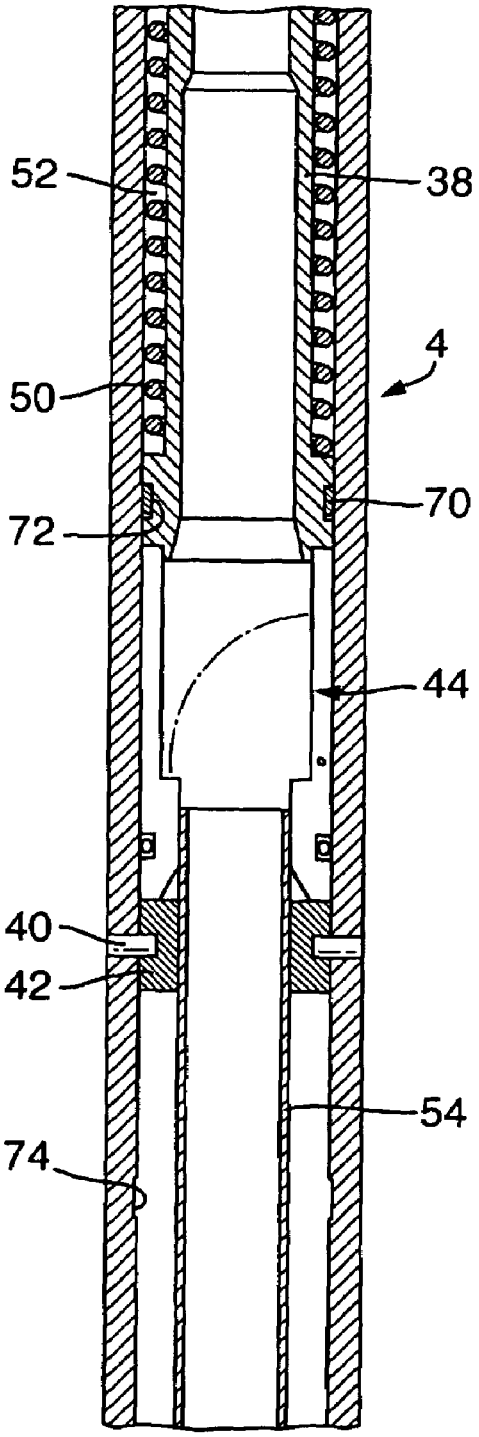
FIG. 5 is a cross-sectional side view of the embodiment of FIG. 1 modified with a lock mechanism wherein the one-way valve is rendered inoperable.
Figure 6:
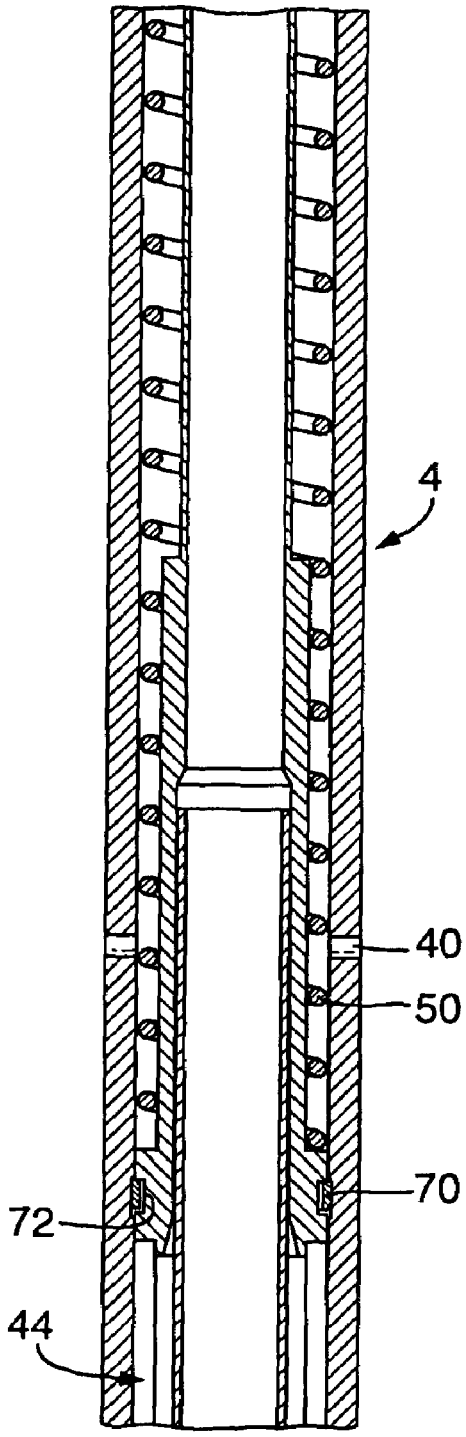
FIG. 6 is a cross-sectional side view of the embodiment of FIG. 5 wherein the one-way valve is operable.

A further modification provides means which actively locks the mandrel 38 in the position shown in FIG. 4. This locking means is shown in FIGS. 5 and 6 in deactivated and activated configurations respectively. The locking means comprises a resilient circlip 70 located in a groove 72 define in the exterior surface of the lower end of the mandrel 38. The arrangement of the circlip 70 and groove 72 is such that the body 4 presses the circlip 70 against its inherent spring bias into the groove 72. The locking means further comprises a circumferential groove 74 provided in a portion of the interior surface of the body 4 located below the shear pins 40. The arrangement is such that, when the mandrel 38 locates in the position shown in FIG. 4, the groove 72 in the mandrel 38 aligns with the groove 74 in the body 4 allowing the circlip 70 to expand radially and span both circumferential grooves 72, 74. In this way, the mandrel 38 becomes locked to the body 4. As such, the flap 46 becomes locked in the inoperable configuration. The downhole edge of the circlip 70 is provided with a chamfer so as to allow the mandrel 38 to be pressed downwardly passed the groove 74 during disassembly of the apparatus.

Figure 7:
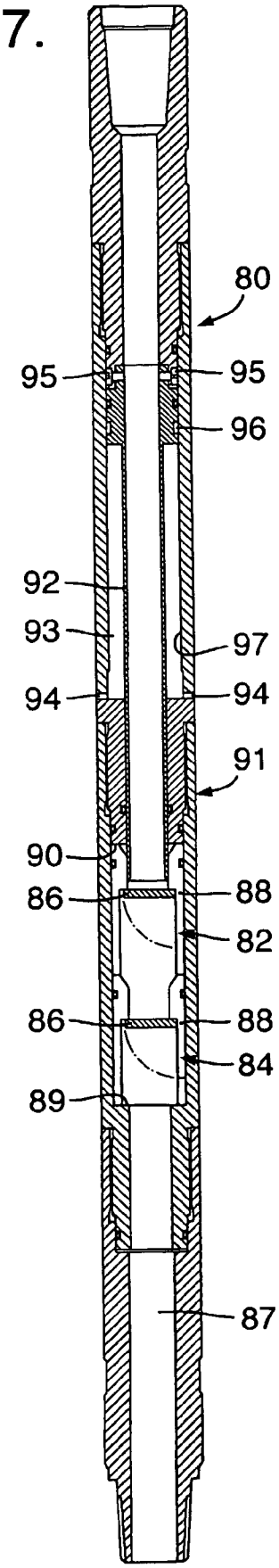
FIG. 7 is a cross-sectional side view of a one-way valve according to the second aspect of the present invention.
Figure 8:
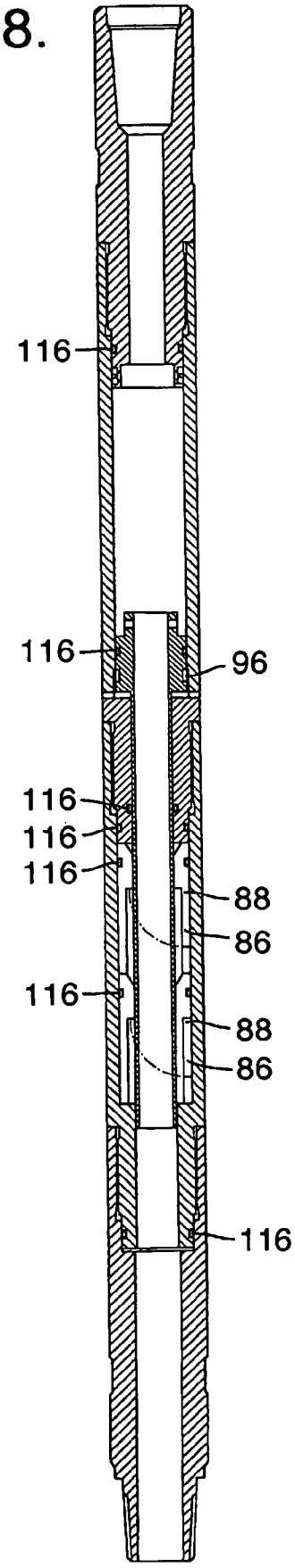
FIG. 8 is a cross-sectional side view of the one-way valve of FIG. 7 rendered inoperable.
Figure 9:
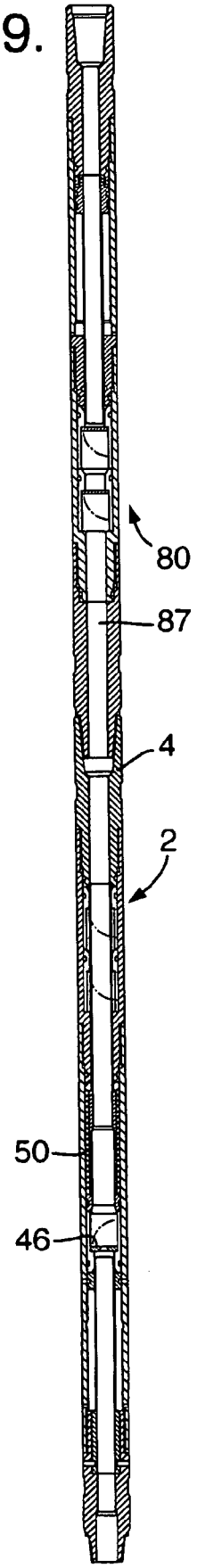
FIG. 9 is a cross-sectional side view of the valve arranged in FIG. 7 connected to the uphole end of the valve arranged in FIG. 1.
Figure 10:
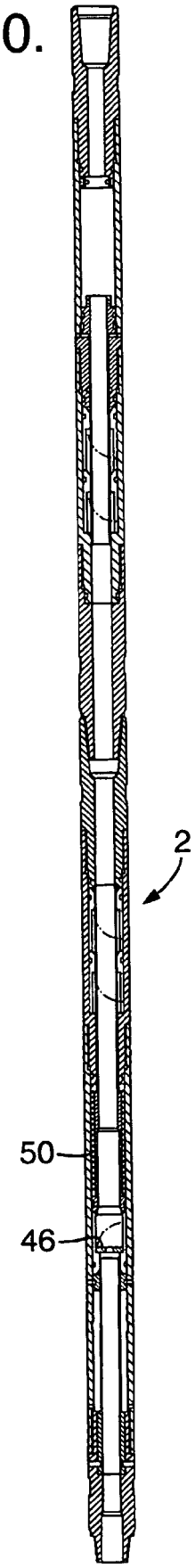
FIG. 10 is a cross-sectional side view of the valve arranged in FIG. 8 connected to the uphole end of the valve arranged in FIG. 1.
Figure 11:
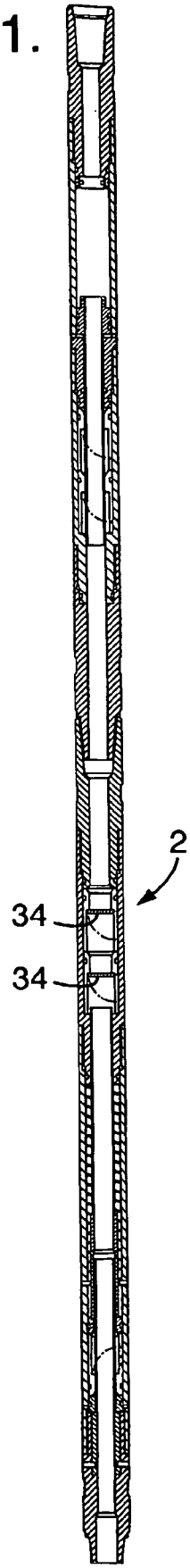
FIG. 11 is a cross-sectional side view of the valve arranged in FIG. 8 connected to the uphole end of the valve arranged in FIG. 4.
Figure 12:
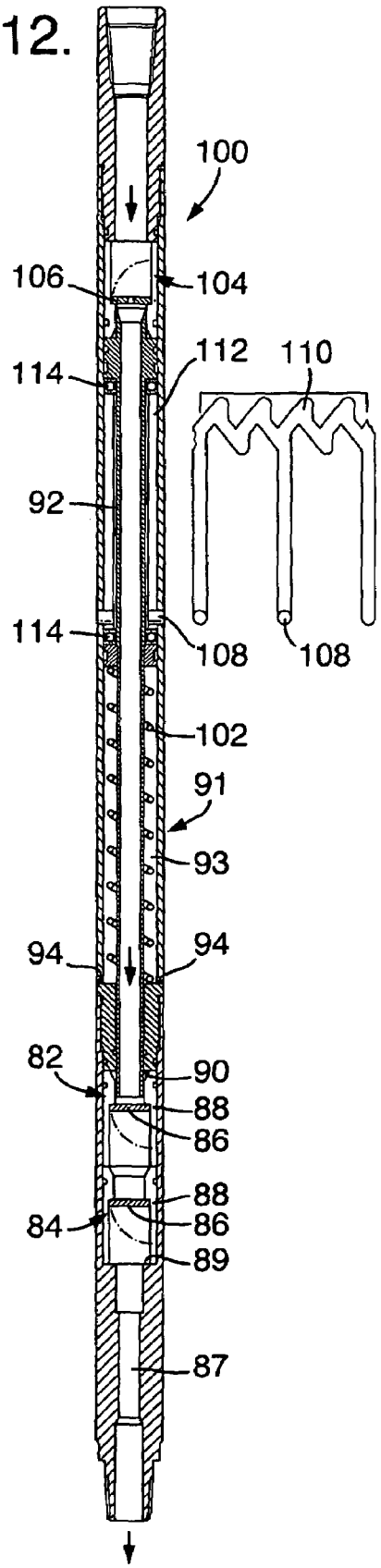
FIG. 12 is a cross-sectional side view of the valve shown in FIGS. 7 and 8 modified so as to comprise a means for repeatedly latching the valve in operable and inoperable configurations.
Figure 13:
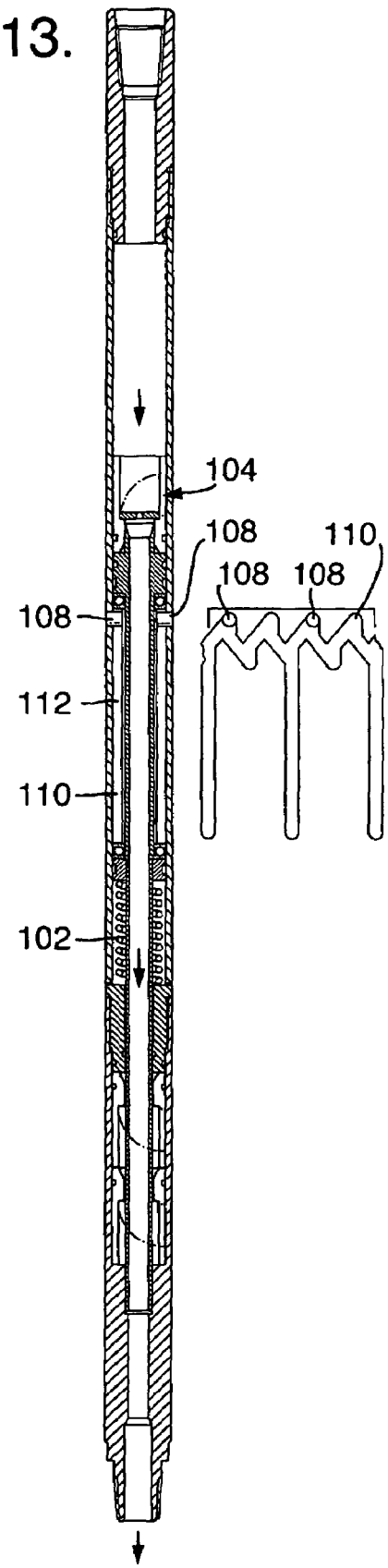
FIG. 13 is a cross-sectional side view of the valve of FIG. 12 pressed by fluid flow into an inoperable configuration.
Figure 14:
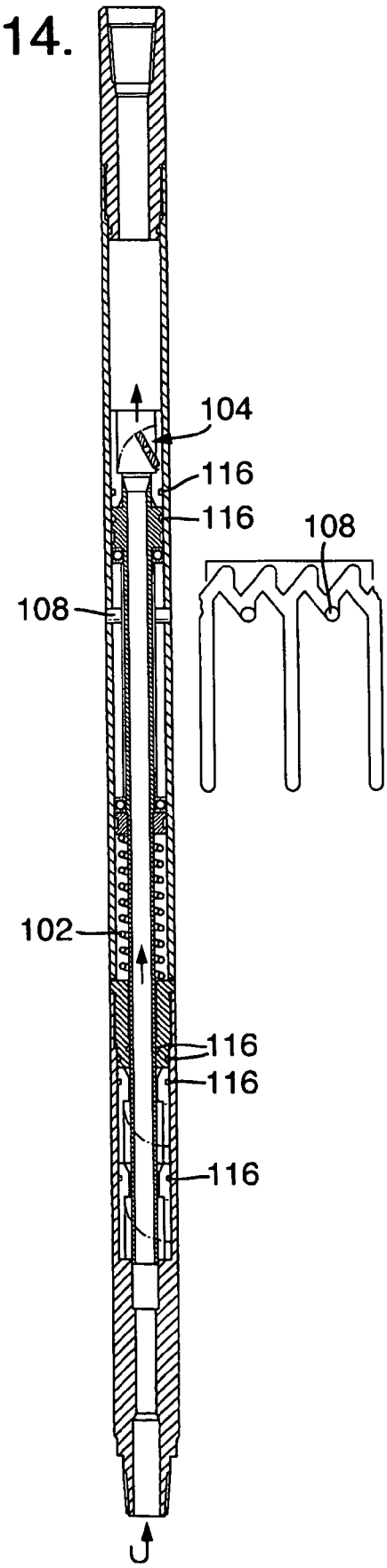
FIG. 14 is a cross-sectional side view of the valve of FIG. 12 latched in an inoperable configuration.

The downhole valve 2 shown in FIGS. 1–4 and as modified in FIGS. 5 and 6 may be used in conjunction with a further downhole valve 80 shown in FIGS. 7 and 8 and/or a yet further downhole valve 100 shown in FIGS. 12–14 of the accompanying drawings. The downhole valve 80 shown in FIGS. 7 and 8 is also shown in FIGS. 9–11 connected to the uphole end of the downhole valve 2 of FIGS. 1–4. The downhole valves 80,100 operate to selectively prevent an uphole flow of fluid through the apparatus whilst running in hole.

In respect of each of the two valves 80,100, two flapper cartridges 82,84 are arranged with the flaps 86 thereof spring biased into an upwardly rotated position wherein each flap 86 extends perpendicularly to the longitudinal axis of the valve so as to block a bore 87 extending longitudinally through the valve 80,100. In this way, each flap 86 prevents an uphole flow of fluid through the apparatus. However, given that the flaps 86 may be pressed and rotated downwardly about a fulcrum 88, a downhole flow of fluid is not necessarily prevented by the flaps 86.

In each of the downhole valves 80,100, the two flapper cartridges 82,84 are retained between uphole facing and downhole facing shoulders 89,90 which extend into the bore 87 of a valve body 91. A mandrel 92 is located uphole of the two flaps 86 and is movable in an axial direction within the bore 87. With reference to the accompanying drawings, it will be understood that, in an uphole position within the bore 87, the mandrel 92 is spaced from the flaps 86 so as to allow said flaps 86 to close the bore 87 to an uphole flow of fluid. However, in moving axially downhole within the bore 87, the downhole end of the mandrel 92 presses against each flap 86 in turn and rotates each flap 86 about the associated fulcrum 88. The bore 87 of the valve body 91 is thereby opened and an uphole flow of fluid may pass through the valve 80,100 via a bore of the mandrel 92. A chamber 93 is provided between an uphole portion of the mandrel 92 and the valve body 91. Apertures 94 are provided in the body 91 so as to vent, in use, the chamber 93 to the annulus and thereby assist axial movement of the mandrel 92.

The two downhole valves 80,100 differ in that the second valve 100 may be repeatedly cycled between configurations wherein the flaps 86 are operative and inoperative whereas the first valve 80 can only be moved from a flap operative configuration (as shown in FIG. 7) to a flap inoperative configuration (as shown in FIG. 8) on a single occasion. In this regard, it will be seen with reference to FIG. 7 that the mandrel 92 of the first valve 80 is retained in the uphole position within the bore 87 by means of a shear mechanism. In the embodiment of FIGS. 7 and 8, the shear mechanism comprises a plurality of shear pins 95 extending from the body 91 of the valve 80 into an uphole end of the mandrel 92. It should be noted that the shear pins 95 are arranged so as to shear, in use, prior to the shear pins 40 of an associated downhole valve 2 as shown in FIGS. 1–4. In other words, the arrangement is such that static fluid pressure may be increased within apparatus comprising the valves 2,80 so that the flaps 86 may be rendered inoperable before the flaps 34 become operable on a subsequent increase of fluid pressure. It will be understood that, once the shear pins 95 of the valve 80 have sheared, the mandrel 92 is permitted to move axially from the position shown in FIG. 7 to the position shown in FIG. 8 (i.e. from a position in which the flaps 86 are operative to a position in which the flaps 86 are inoperative). In this latter position of the mandrel 92, a snap ring in the form of a circlip 96 locates downhole of a downhole facing shoulder 97 in the bore 87. Abutment of the circlip 96 against the shoulder 97 locks the mandrel 92 in the position relative to the body 91 shown in FIG. 8.

The valve 80 shown in FIGS. 7 and 8 is shown in FIGS. 9–11 connected to the valve 2 of FIGS. 1–4. In FIG. 9, the valve 80 is shown arranged as in FIG. 7 whilst the valve 2 is shown arranged as illustrated in FIG. 1. In FIG. 10, the valve 80 is arranged as shown in FIG. 8 whilst the valve 2 is again arranged as illustrated in FIG. 1. In use, the valve 80 is moved from the arrangement of FIG. 9 to that of FIG. 10 by increasing the static fluid pressure within the bore 87. The geometry of the mandrel 92 and the placement of seals between the mandrel 92 and the body 91 ensures the portion of mandrel 92 defining the chamber 93 is exposed merely to annulus fluid pressure and this allows fluid within the bore 87 to apply a resultant downhole force to the mandrel 92. The shear pins 95 may be thereby sheared. However, as noted above, the fluid conditions resulting in this shearing of the shear pins 94 do not result in a shearing of the shear pins 40 of the lower valve 2. Nevertheless, once the flaps 86 of the upper valve 80 have been rendered inoperable so as to allow an uphole flow of fluid, fluid pressure may be further increased and the shear pins 40 of the lower valve 2 sheared in order to then prevent uphole fluid flow by means of the flaps 34 of lower valve 2 (as shown in FIG. 11).

The downhole valve 100 shown in FIGS. 12–14 comprises latch means which allows the mandrel 92 to be selectively retained in an uphole position (see FIG. 12) or a downhole position (see FIG. 14). When in the downhole position, the mandrel is retained by the latch means against the uphole bias of a compression spring 102. The compression spring 102 is located in a downhole part of the chamber 93 defined between the mandrel 92 and the valve body 91. The mandrel 93 is, in use, moved downhole against the bias of the spring 102 by the action of fluid pressure on the mandrel 92. In the embodiment shown in FIGS. 12–14, a flapper cartridge 104 is secured to the uphole end of the mandrel 92 so as to allow ready movement of the mandrel 92 by means of dynamic fluid pressure. The flap 106 of the flapper cartridge 104 comprises an aperture so as to allow a downhole flow of fluid through the valve bore 87. The arrangement of the flapper cartridge 104 is such that an uphole flow of fluid through the valve bore 87 may rotate the flap 106 upwardly into a position which does not obstruct the bore 87. If circumstances allow, the flapper cartridge 106 may be omitted or replaced with a conventional nozzle attached to the mandrel 92.

The means by which the mandrel 92 can be repeatedly latched comprises a pin and groove control arrangement. More particularly, in the valve 100 shown in FIGS. 12–14, two pins 108 are mounted diametrically opposite one another to the valve body 91. The pins 108 extend radially inward from the body 91 into an indexing groove 110 provided on the exterior surface of a cylindrical indexing sleeve 112. The indexing sleeve 112 is located in an uphole part of the chamber 93 and is pressed uphole against a downhole facing shoulder of the mandrel 92 by the spring 102. A thrust bearing 114 is located at either end of the cylindrical sleeve 112 so as to assist in a ready rotation of the sleeve 112 relative to the mandrel 92, spring 102, and the valve body 91. It will be understood that, in an alternative embodiment, the pins 108 may be provided on the indexing sleeve 112 with the groove 110 provided in the valve body 91.

It will be understood that, as fluid pressure is applied to the mandrel 92 and the mandrel 92 is moved axially downhole relative to the body 91, the pins 108 move within the indexing groove 110. As the mandrel 92 moves from the uphole position shown in FIG. 12 to the downhole position shown in FIG. 13, the pins 108 move within the groove 110 in such a way as to rotate the sleeve 112. If fluid pressure is reduced, the mandrel 92 may move from the position shown in FIG. 13 to the position shown in FIG. 14 under the action of the spring 102. This latter axial movement is relatively small and the flaps 86 are retained in an inoperative configuration. The pins 108 again move within the groove 110 and this generates a further rotation of the sleeve 112. However, it will be understood from FIG. 14 that the pins 108 locate in a portion of the groove 110 which prevents movement of the mandrel 92 uphole without the mandrel 92 first being moved downhole relative to the valve body 91. The groove 110 forms a closed loop. The loop is formed about the longitudinal axis of the valve 100 and so the pins 108 may be repeatedly cycled through the entirety of the groove 110. This allows a repeated cycling of the mandrel 92 between uphole and downhole positions in which the flaps 86 are operable and inoperable. A snap ring mechanism for locking the mandrel 92 to the valve body 91 is not provided in the downhole valve 100.

In use, the downhole valve 100 may be connected to the uphole end of the downhole valve 2 shown in FIGS. 1–4 in a similar manner to that described in relation to downhole valve 80 of FIGS. 7 and 8. However, in general, it is envisaged that the valve 100 will be used without the need for the other valves 2,80.

The downhole valve 80,100 shown in FIGS. 7 and 8 and FIGS. 12–14 comprise a plurality of seals 116 which prevent the flow of fluid between component parts. Also, the mandrel of the valve 80 shown in FIGS. 7 and 8 may be provided with a nozzle or a flapper cartridge wherein the flap comprises an aperture so as to allow ready movement of the mandrel with dynamic fluid pressure. It will also be understood that the three valves 2,80,100 shown in the accompanying drawings can, in practice, be used on their own and independently of the other two valves. Alternatively, the valves may be used in combination with each other.

The invention claimed is:

1. A downhole annulus flushing valve comprising: a body having a bore extending longitudinally therethrough; a one-way valve for allowing fluid to flow in a first direction through the bore and preventing fluid flow in a second direction through the bore, the second direction being opposite to the first direction; means for rendering the one-way valve inoperable so as to be ineffective at preventing fluid flow; a one-way flow restrictor which permits substantially unrestricted flow through the body in the second direction and restricts flow through the body in the first direction; and means for selectively making the one-way valve operable so as to be effective at allowing fluid flow in said first direction and preventing fluid flow in said second direction.

2. The downhole annulus flushing valve according to claim 1, wherein the means for selectively making the one-way valve operable is also effective to disable the one-way restrictor so that it permits substantially unrestricted flow through the body.

3. The downhole annulus flushing valve as claimed in claim 1, wherein the means for rendering the one-way valve inoperable comprises means for restricting movement of said valve.

4. The downhole annulus flushing valve as claimed in claim 3, wherein said movement restricting means is movable relative to the tool body and is biased towards a position wherein movement of the one-way valve is not restricted so as to render said valve inoperable.

5. The downhole annulus flushing valve as claimed in claim 3, wherein said means for selectively making the one-way valve operable comprises said one-way flow restrictor.

6. The downhole annulus flushing valve as claimed in claim 5, wherein the one-way flow restrictor is mounted on said movement restricting means with a pivotal connection so that the one-way flow restrictor tends to be moved to a first position by a fluid flowing through the tool bore in said first direction.

7. The downhole annulus flushing valve as claimed in claim 5, wherein means are provided for retaining the one-way flow restrictor in a second position when said movement restricting means is in a position wherein movement of the one-way valve is not restricted so as to render said valve inoperable.

8. The downhole annulus flushing valve as claimed in claim 5, wherein the one-way valve is biased towards a position in which the one-way valve is operable.

9. The downhole annulus flushing valve as claimed in claim 3, wherein said means for selectively making the one-way valve operable comprises means for releasably retaining said movement restricting means in a position wherein the one-way valve is inoperable.

10. The downhole annulus flushing valve as claimed in claim 9, wherein said means for releasably retaining said movement restricting means comprises a shear pin securing said movement restricting means to the tool body.

11. The downhole annulus flushing valve as claimed in claim 9, wherein said means for releasably retaining said movement restricting means comprises a latching means.

12. The downhole annulus flushing valve as claimed in claim 11, wherein said latching means comprises a pin mounted to one of the tool body and movement restricting means; and a groove, for receiving the pin, mounted in the other of the tool body and movement restricting means.

13. The downhole annulus flushing valve as claimed in claim 12, wherein the groove defines a closed loop.

14. The downhole annulus flushing valve as claimed in claim 1, wherein the one-way valve comprises a closure member pivotally mounted to the tool body and movable between a first position in which fluid within the body bore may flow past the closure member, and a second position in which fluid within the body bore is prevented from flowing past the closure member so that fluid on one side of the closure member is isolated from fluid on an opposite side of the closure member.

* * * * *